United States Patent [19]

Staats

[11] 3,995,886

[45] Dec. 7, 1976

[54] HEAT REACTIVATIBLE ADHESIVE BOOK BINDING

[75] Inventor: Henry N. Staats, Deerfield, Ill.

[73] Assignee: General Binding Corporation Northbrook, Ill.

[22] Filed: Aug. 14, 1975

[21] Appl. No.: 604,659

[52] U.S. Cl. ..... 281/21 R; 11/1 AD; 156/227; 156/295

[51] Int. Cl.[2] ..... B42D 1/00

[58] Field of Search ..... 281/21 R; 11/1 AD; 156/227, 295, 499, 555

[56] References Cited

UNITED STATES PATENTS

| | | | |
|---|---|---|---|
| 2,798,021 | 7/1957 | Land | 156/295 |
| 3,711,355 | 1/1973 | Staats et al. | 156/499 |
| 3,847,718 | 11/1974 | Watson | 161/99 |

*Primary Examiner*—Jerome Schnall

*Attorney, Agent or Firm*—Hill, Gross, Simpson, Van Santen, Steadman, Chiara & Simpson

[57] ABSTRACT

A method and apparatus for permanently binding sheets of paper into a cover inexpensively and quickly is disclosed. The cover has a top and bottom leaf with a center fold therebetween and a folding score on each leaf near the center fold. An elongated strip of heat reactivatible adhesive is applied to the inner surface of one or both of the leaves between the folding score on the leaf and the center fold. A plurality of sheets are positioned adjacent the strip or strips of adhesive and the entire assembly is then fed into a laminator machine which heats and presses the heat reactivatible adhesive to cause it to flow back towards the sheets. As the adhesive cools the ends of the sheets are held in intimate contact between the leaves near the center fold.

6 Claims, 5 Drawing Figures

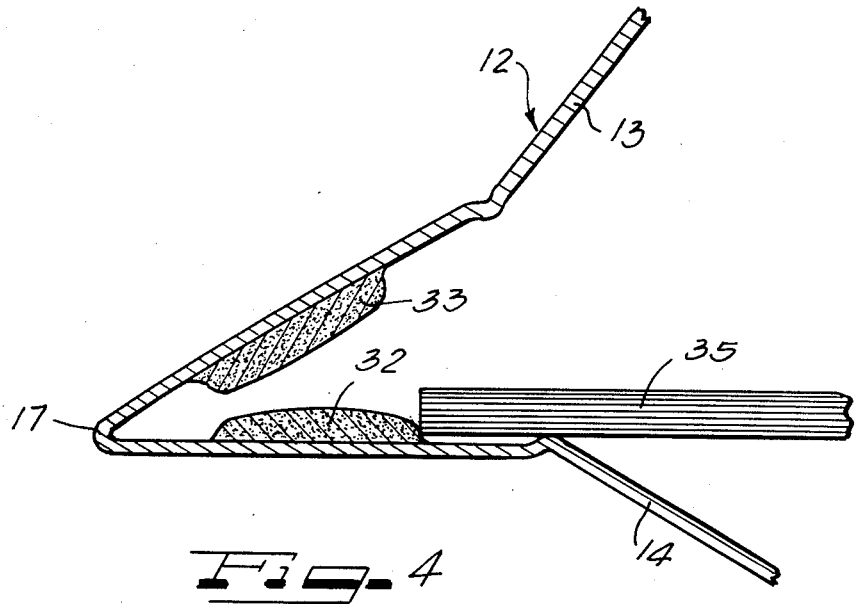
Fig. 4
Fig. 5
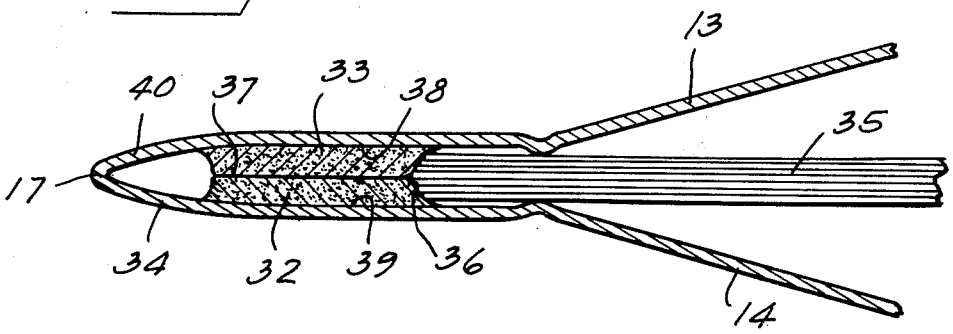

HEAT REACTIVATIBLE ADHESIVE BOOK BINDING

BACKGROUND OF THE INVENTION

This invention relates to a method and apparatus for binding sheets of paper inside a cover, and, more particularly, to a permanent binding utilizing a heat-reactivatible adhesive.

My copending application, U.S. Ser. No. 265,305, describes a binding method wherein a quantity of heat-reactivatible adhesive is applied to the inside of a cover near the junction point of the leaves. A plurality of sheets are then placed into the cover such that ends of the sheets are near the junction of the leaves. The apparatus is then subjected to an oscillatory motion and heat which causes the molten adhesive to flow and intimately engage the ends of the sheets. Upon cooling, the assembly forms a bound book. Such a bound book or binding method is particularly suitable for a plurality of sheets whose thickness is greater than approximately one-eighth inch. With bound books having a final thickness of less than one-eighth inch, the process is less efficient and some of the pages may not be engaged by the molten adhesive.

A disadvantage with prior art binding methods for loose sheets in the need to introduce mounting holes into the cover and the paper sheets. Also, binding methods such as spiral wire or plastic loops must be carefully threaded through the cover and paper sheets, resulting in low production time and expensive machinery.

SUMMARY OF THE INVENTION

According to the invention, a binding method and apparatus is disclosed for permanently attaching a cover to a plurality of paper sheets having no prepunched holes and having a relatively small total thickness such as on the order of one-eighth inch. The cover is folded at the center along a center fold or mid-score to form front and rear leaves. An elongated strip of heat reactivatible adhesive is applied to one or both of the leaves parallel to and adjacent the center fold. A plurality of sheets of paper to be bound are then positioned adjacent the heat reactivatible adhesive strip opposite the center fold. The assembly is then fed to a laminator with a nip formed by the center score being engaged first by two feed rollers. As the nip of the cover proceeds through the laminator two heater elements above and below the leaf covers melt the adhesive. Finally, the nip is engaged by two exit rollers which cause the molten adhesive to flow back into intimate contact with the ends of the sheets of paper. As the exit rollers compress the adhesive a cooling effect occurs due to the low relative temperature of the exit rollers.

Each leaf is scored parallel with the center fold to permit folding back of the leaves without overstressing the adhesive bond formed between the sheets of paper leaves near the center fold.

In an alternate embodiment, a heat reactivatible adhesive strip is applied to each of the leaves near the center fold. The two strips are then placed in contact and heat is applied to cause them to join. Finally, a plurality of sheets which may be thicker than sheets bound in the previously described embodiment are placed adjacent the junction of the two adhesive strips. Finally, the assembly is processed in a laminator. This latter embodiment has the advantage of permitting a simple alignment of the sheets to be bound by butting the sheets at the junction of the two adhesive strips.

It is an object of this invention to provide a new binding method for permanently attaching covers to a plurality of paper sheets.

It is a further object of this invention to utilize one or more strips of the hot melt adhesive as a retaining means which can be quickly and inexpensively employed to permanently attach to cover paper sheets which do not have prepunched holes.

It is another object of this invention to provide a retaining means for a plurality of paper sheets having a thickness of approximately one-eighth inch or less.

It is yet another object of this invention to utilize a strip of heat reactivatible adhesive as a retaining means, one strip being melted to a rear cover leaf and a second strip to a top cover leaf, sheets of paper then being aligned against these strips and heated with a single machine to laminate and bind the cover in a single operation.

BRIEF DESCRIPTION OF THE DRAWINGS:

FIG. 4 is a cross-sectional side view of a second embodiment of this invention in which two heat reactivatible adhesive strip are utilized; and FIG. 5 is a cross-sectional side view of a third embodiment of this invention in which two adhesive strips are joined prior to a binding operation.

Figure 1:
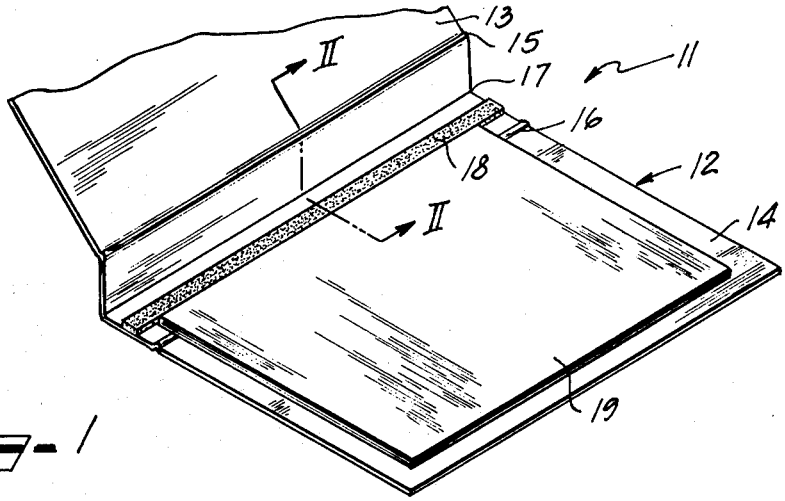
FIG. 1 is a perspective view of a book about to be bound in accordance with the teachings of this invention.

DESCRIPTION OF THE PREFERRED EMBODIMENTS:

The principles of the present invention are particularly useful when embodied in a bound book generally indicated by numeral 11. A binder or cover 12 is folded along a center fold or mid-score 17 to form a top leaf 13 and a bottom leaf 14. A heat reactivatible adhesive strip 18 is applied to the inside of the bottom leaf 14 adjacent the mid-score 17. The plurality of paper sheets to be bound 19 are positioned adjacent the adhesive strip 18 and opposite the mid-score 17. A folding score 15 on the top leaf 13 and a folding score 16 on the bottom leaf 14 are positioned parallel to and adjacent the mid-score 17. When the top and bottom leaves 13 and 14 are fastened together by melting the adhesive strip 18, the folding scores 15 and 16 permit flexing of the leaves without stressing the adhesive.

Figure 2:
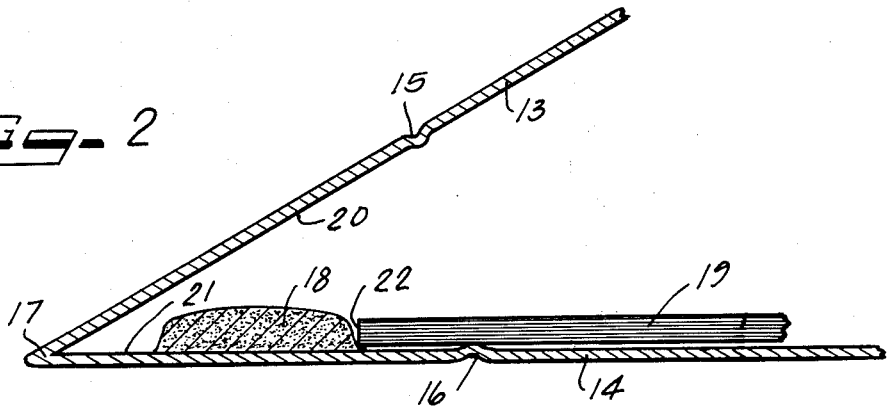
FIG. 2 is a cross-sectional side view taken along line I—I of the book illustrated in FIG. 1.

The lateral position of the adhesive strip 18 on the bottom leaf 14 is best illustrated in FIG. 2. The inside portion of the leaf 14 between the mid-score 17 and folding score 16 serves as a binding surface 21 to which the elongated adhesive strip 18 is applied. The strip 18 is approximately centered between the folding score 16 and mid-score 17 with a gap being provided adjacent the mid-score 17 to promote flexing by preventing the adhesive strip 18 from flowing over the mid-score 17. A similar gap is also provided between the adhesive strip 18 and the folding score 16 to permit the plurality of paper sheets 19 to be supported by a portion of the binding surface 21. Edges 22 of the paper sheets 19 are aligned prior to the laminating process by positioning these edges directly adjacent the side walls of the adhesive strip 18 but not necessarily in contact therewith. Prior to melting, the adhesive strip 18 occupies approximately half of the available area on the binding surface, thus providing a space for the adhesive strip 18 to flow when melted. A binding surface 20 on the inside of the upper leaf 13 between the mid-score 17 and folding score 15 provides a surface for adhesive contact with the top of the strip 18 during the lamination process.

Figure 3:
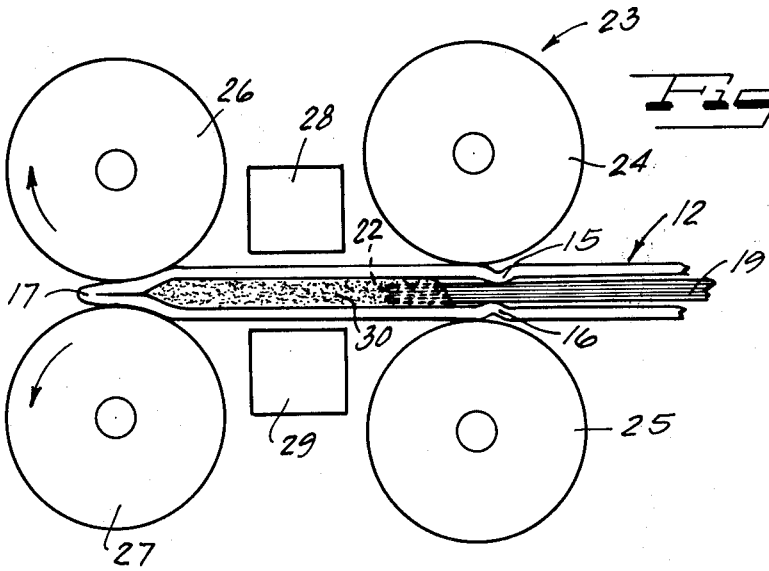
FIG. 3 is a side view of a laminator illustrating a binding operation of this invention.

Referring now to FIG. 3, a laminator 23 is illustrated having upper and lower feed rollers 24 and 25, upper and lower exit rollers 26 and 27, and upper and lower heaters 28 and 29 between the feed and exit rollers. After placement of the sheets 19 adjacent the adhesive strip 18, the top leaf 13 is folded down. The assembly comprising the sheets 19 and cover 12 is inserted into the laminator 23 by engaging the nip formed by the mid-score 17 in the feed rollers 24 and 25. A particularly suitable laminator for this operation is described in U.S. Pat. No. 3,711,355. As the cover 12 moves through the laminator, the heat reactivatible strip 18 melts to form a molten adhesive 30. As the cover 12 exits the machine and the nip 17 is engaged by the exit rollers 26 and 27, these rollers exert pressure upon the molten adhesive 30 and cause it to flow back around the edges 22 of the sheets 19. At this precise moment, the sheets 19 are only mildly compressed and minute spaces exist between the sheets 19. Therefore, the fluid adhesive 30 is forced to touch the edges of the sheets and flow into the spaces between the sheets. Shortly thereafter, the sheets 19, now bearing the melted adhesive 30, are squeezed by the exit rollers 26 and 27 to cause the melted adhesive 30 and sheets 19 to join in intimate contact. Although the exit rollers 26 and 27 are in close proximity to the heaters 28 and 29, they are substantially cooler than these heaters, therefore allowing the roller 26 and 27 to chill and cause an initial hardening of the adhesive 30. Thus, as the center fold or nip 17 of the cover 12 exits from the laminator 23, the sheets 19, cover 12, and adhesive 30 are intimately fastened to one another.

After the adhesive 30 cools, the leaves may be flexed at their folding scores 15 and 16 without unduely stressing the adhesive 30 since the scores are sufficiently spaced from the center fold 17 to prevent the melted adhesive 30 from flowing over or past the folding scores 15 and 16.

The finished product has a neat, flat, and commercial appearance with a high degree of integrity. The sheets 19 cannot be removed except by tearing.

FIG. 4 illustrates a second embodiment which permits binding a group of paper sheets somewhat thicker than the embodiment of FIGS. 1 – 3. The bound book of FIG. 4 has a construction similar to the first embodiment except that a second heat reactivatible adhesive strip 33 is added to the top leaf 13 and is positioned to align with a first adhesive strip 32 which is applied to the bottom leaf 14. When the cover 12 is folded, the tops of strips 32 and 33 align and abut. If the two adhesive strips 32 and 33 have individual thicknesses of 0.03 inches, the strips together total 0.06 inches in thickness. These strips will supply a sufficient amount of material to bind a large group of sheets 35. Twenty sheets having individual thicknesses of 0.003 inches can typically be bound in this manner. However, as many as thirty sheets of 0.0035 inch paper with a total adhesive thickness for both strips of 0.1 inches to 0.11 inches have been successfully bound. The relationships are not exact and the teachings of this invention will continue to operate on even thicker assemblies, the only limitation being the ability of the laminator 23 to engage the cover 12 at its nip 17.

A third embodiment illustrated in FIG. 5 is preferred, and is similar in construction to that described in the second embodiment except that the cover 12, having the two adhesive strips 32 and 33, is closed during manufacture and the strips 32 and 33 are heated to permit them to join at an adhesive junction 37. Therefore, a large group of paper sheets 35 may be thrust into the cavity formed by this construction and the joined adhesive strips 32 and 33 provide an automatic register for alignment of ends 36 of the large group of paper sheets 35 without requiring a careful placement as required in the first two embodiments.

To facilitate binding a large group of paper sheets 35, upper and lower convexities 40 and 34 are provided adjacent the center fold or nip 17. These convexities bend outward and permit the leaves 13 and 14 of the cover 12 to lie flat against the bound paper sheets 35. The convexities 40 and 34 preferably provide a sufficient gap between the adhesive strips 32 and 33 and center fold 17 such that when these strips are melted the adhesive will not flow completely over the convexities and thereby inhibit the flexibility near the center fold 17. Also, by providing such convexities, the leaves 13 and 14 will not require any bending or stressing at the upper binding surface 38 or lower binding surface 39 beneath the adhesive strips 33 and 32 respectively. If such binding did occur beneath the strips, they could break loose and the result would be a poor bind.

The cover 12 is typically comprised of a paper stock, but is not restricted to this material. Lower temperatures and a laminator 23 permit use of linear polyethylene.

Heat reactivatible adhesive strips can be applied to covers 12 by equipment manufactured by the Nordstrom Company and others.

Various heat reactivatible adhesives of the type described in application U.S. Ser. No. 265,305 filed June 22, 1972, now abandoned may be employed in the various embodiments of this invention.

Although various minor modifications may be suggested by those versed in the art, it should be understood that I wish to embody within the scope of the patent warranted hereon, all such embodiments as reasonably and properly come within the scope of my contrubution to the art.

I claim as my invention:

1. A method of securing a plurality of sheets to a cover having first and second leaves and a center fold therebetween comprising the steps of:

a. applying a strip of heat reactivatible adhesive to one of the leaves adjacent, but not in contact with the center fold;

b. positioning the ends of a plurality of paper sheets adjacent the strip of heat reactivatible adhesive;

c. folding the leaves together with the paper sheets therebetween;

d. heating the cover adjacent the heat reactivatible adhesive to melt said adhesive; and e. compressing the cover at the center fold to force the melted adhesive to flow into contact with the other leaf and around the edges of the plurality of sheets.

2. The method of claim 1 including the additional step of compressing and rolling the melted adhesive surrounding the edges of the plurality of sheets with rollers to provide an intimate contact between said sheets and the melted adhesive.

3. The method of claim 1 including the additional step of applying a second strip of heat reactivatible adhesive to the other leaf prior to positioning the paper, said second strip being aligned with the other strip when the leaves of the cover are folded closed.

4. The method of claim 3 including the additional step of melting the tops of the two strips together by applying heat when the leaves are folded upon one another, and using the melted-together strips as an automatic alignment when inserting the paper sheets by butting the ends of the paper against the barrier formed by the melted strips.

5. The method of claim 1 including the additional step of scoring each leaf of the cover to permit bending of each leaf without stressing the adhesion between the melted adhesive and the leaf portions near the center fold.

6. A method of securing a plurality of sheets to a cover comprising the steps of:

a. folding a cover in half along a center fold;

b. applying a strip of heat-reactivatible adhesive to one of the leaves parallel to, but not in contact with the center fold;

c. positioning the ends of a plurality of paper sheets adjacent the strip of heat reactivatible adhesive;

d. folding the leaves together with the paper sheets therebetween;

e. heating the cover adjacent the heat reactivatible adhesive strip to melt said adhesive;

f. roll compressing the cover from the center fold back toward the melted adhesive to force the melted adhesive to flow into contact with the other leaf and around the edges of the plurality of sheets; and g. continuing the roll compression of the cover to compress the melted adhesive surrounding the edges of the plurality of sheets to cool said adhesive and to provide an initimate contact between said sheets and the melted adhesive.

* * * * *